US005394150A

United States Patent [19]

Naito et al.

[11] Patent Number: 5,394,150

[45] Date of Patent: Feb. 28, 1995

[54] BROAD-BAND RADIO WAVE ABSORBER

[76] Inventors: Yoshiyuki Naito, 9-29, Tsukimino 8-chome, Yamato-shi, Kanagawa-ken; Michiharu Takahashi, 390-190, Takatsu, Yachiyo-shi, Chiba-ken, both of Japan

[21] Appl. No.: 976,373

[22] Filed: Nov. 13, 1992

[51] Int. Cl.[6] ..... H01Q 17/00

[52] U.S. Cl. ..... 342/4; 342/1

[58] Field of Search ..... 342/1, 4

[56] References Cited

U.S. PATENT DOCUMENTS

| | | | |
|---|---|---|---|
| 3,441,933 | 4/1969 | Tuinila et al. | 342/4 |
| 4,972,191 | 11/1990 | Ishino et al. | 342/1 |
| 4,973,963 | 11/1990 | Kurosawa et al. | 342/4 |
| 5,113,190 | 5/1992 | Klein | 342/4 |

FOREIGN PATENT DOCUMENTS

| | | | |
|---|---|---|---|
| 0776158 | 6/1957 | United Kingdom | 342/4 |

*Primary Examiner*—Gilberto Barron, Jr.

*Attorney, Agent, or Firm*—Antonelli, Terry, Stout & Kraus

[57] ABSTRACT

A broad-band radio wave absorber with a plurality of pieces of a magnetic member disposed parallel to each other or in a crosswise way on a reflecting plate. Each of the pieces of the magnetic member is configured in such a manner that its thickness is arranged so as to become smaller from its bottom toward its top in a stepwise fashion and that so as to be longer than its bottom thickness. Further, each of the pieces of the magnetic member is disposed in a relationship spaced away from the adjacent pieces thereof in such a predetermined distance longer than the bottom thickness of each piece thereof.

6 Claims, 21 Drawing Sheets

BROAD-BAND RADIO WAVE ABSORBER

BACKGROUND OF THE INVENTION

1. Field of the Invention

The present invention relates to a broad-band radio wave absorber and, more particularly, to a radio wave absorber made of a ferrite as a magnetic substance, in which its frequency range is made broader. The broad-band radio wave absorber is extensively employed as a material for a wall of a radio wave anechoic chamber adapted so as to measure a radio wave radiated from electronic devices and for a wall for a prevention of the reflection of a radio wave for television from buildings.

2. Description of the Related Art

Heretofore, as a method for making the frequency range of a radio wave absorber composed of a single layer of a ferrite broader, there has been proposed a method in which a ferrite as in a form of tiles is so disposed as to be away from a reflecting plate, for example, a polyurethane foam plate or the like, containing a layer of air.

For instance, when 7 mm-thick tiles of a sintered NiZn ferrite are placed in a spaced relationship away in 8 mm to 15 mm from a reflecting plate, a broad-band radio wave absorber can be prepared which has a reflectivity of −20 dB or smaller for the frequency band of 30 MHz to 1,000 MHz. On the other hand, broad-band radio wave absorbers of a fin type and of a lattice type have been proposed by the present inventors. Of the broad-band radio wave absorbers proposed, the broad-band radio wave absorber of the lattice type, prepared by making a sintered NiZn ferrite in a form of a lattice of 7 mm thick and 20 mm high, may have a reflectivity of −20 dB or lower for a range of 30 MHz to 700 MHz.

FIG. 18 is a sectional view showing a typical structure of a radio wave absorber of a ferrite type in which a plate F of a sintered ferrite as in a tile form is arranged on a conductive metal plate M for reflecting the radio wave. When the reflection coefficient of on a surface of the ferrite absorber is indicated by "s", the power absorption coefficient of the wave absorption body is given by the following formula (1):

$$1-|s|^2$$

Thus, it can be said that the smaller the reflection coefficient $|s|$ the better the absorber.

It is noted herein that a standard is usually set up by the following formula (2):

$$|s| \leqq 0.1$$

In other words, the reflectivity is set to be equal to or smaller than −20 dB (20 log s dB), and the absorption coefficient is set to be equal to or larger than 0.99.

The characteristics of the radio wave absorber as shown in FIG. 18 may be indicated as shown in FIG. 19 in which the x-axis is set by frequency f and the y-axis is set by the magnitude of reflection coefficient $|s|$. In this case, when the lower of two frequencies for which $|s|=0.1$ is fL and the higher is fH, then the band width B for which $|s| \leqq 0.1$ is satisfied becomes (3):

$$B=fH-fL$$

A further description will be made of the band width of the frequency.

When the lower limit frequency fL is set to 30 MHz, the ferrite to be employed is of a sintered NiZn type or of a sintered MnZn type. In this case, the resulting absorber may generally give the upper limit frequency fH of 300 MHz to 400 MHz.

On the other hand, the lower limit frequency fL is set to 90 MHz. In this case, the resulting absorber may generally give the upper limit frequency fH of 350 MHz to 520 MHz.

If the ferrite of the sintered NiZn type or of the sintered MnZn type is to be employed as the wall material for the radio wave darkroom for measuring the radio wave radiated from electronic devices, the upper limit frequency fH is usually required to satisfy fH=1,000 MHz when the lower limit frequency fL is set to 30 MHz. Hence, the ferrite as exemplified hereinabove does not satisfy the characteristic for the upper limit frequency.

On the other hand, if the ferrite of the sintered type is to be employed as the material for the wall for the purpose to prevent a reflection of the radio wave for television from buildings, the upper limit frequency fH is usually required to satisfy fH=800 MHz, when the lower limit frequency fL is set to 90 MHz. In this case, the ferrite as exemplified hereinabove is insufficient in terms of the upper limit frequency.

Furthermore, proposals have been made of improvements in the broad-band radio wave absorber of such a type as shown in FIG. 18.

One proposal for making a band width of the radio wave absorber broader is such that an air layer, a dielectric material or a loss dielectric material, as indicated by reference symbol "D", is interposed between ferrite F and a metal plate M as shown in FIG. 20. This broad-band radio wave absorber, however, can provide the lower limit frequency fL of 30 MHz and the upper limit frequency fH of 1,000 MHz at the most.

Another proposal for making the band wider is made by the present inventors, as disclosed in Japanese Patent Application No. 162,403/1990, that sintered ferrites are disposed at a predetermined interval S on a conductive metal plate, each ferrite having a height, as indicated by reference symbol h, and a thickness, as indicated by reference symbol t, the height h being larger than the thickness t, as shown in FIGS. 21A, 21B and 22. For brevity of description, the arrangement for the sintered ferrites as shown in FIGS. 21A and 21B will be hereinafter referred to as a fin-type radio wave absorber and the arrangement for them as shown in FIG. 22 will be hereinafter referred to as a lattice-type radio wave absorber. The lattice-type radio wave absorber is adapted for a bidirectional polarization of an incident wave. On the other hand, the fin-type radio wave absorber is structured in such a manner that the ferrites extending laterally or transversely are removed from the lattice-type radio wave absorber and it is adapted for a unidirectional polarization of an incident wave; however, its basic operation is the same as that of the lattice-type radio wave absorber. For instance, the fin-type radio wave absorber as shown in FIGS. 21A and 21B gives the upper limit frequency fH=2,400 MHz, and the lattice-type radio wave absorber as shown in FIG. 22 gives the upper limit frequency fH=700 MHz to 1,500 MHz.

It is anticipated that, as a higher frequency will be needed for operating electronic devices and, as a result, the frequency of a radio wave radiated will become higher, a higher upper limit frequency fH will be required as a matter of course.

Further, recently, an interest in EMI (ElectroMagnetic Interference) is growing so that a radio wave absorber having a broader band is desired.

SUMMARY OF THE INVENTION

Therefore, the object of the present invention is to provide a broad-band radio wave absorber and, more particularly, to provide technology capable of competing with the demand for a broader frequency in a radio wave absorber with a ferrite section and a space section disposed alternately in a recurring manner on a reflecting plate.

In order to achieve the aforesaid object, the present invention consists of a broad-band radio wave absorber with a plurality of pieces of a ferrite magnetic member disposed parallel to each other or in a crosswise way on a reflecting plate each of the pieces of the ferrite magnetic member comprising a plurality of portions superimposed in turn in a stepwise fashion; wherein each of the pieces of the ferrite magnetic member is configured in such a manner that the thickness of each portion thereof is arranged so as to become smaller from the bottom of the piece towards the top of the piece and the total height of the piece of ferrite magnetic member is longer than the thickness of the lowest portion of the piece of the ferrite magnetic member; wherein each of the pieces of the ferrite magnetic member is disposed in a relationship spaced away from the adjacent pieces of the ferrite magnetic member in such a distance as being longer than the thickness of the lowest portion of the piece of the ferrite magnetic member; and wherein all of the portions of the piece of the ferrite magnetic member are composed of sintered ferrite material.

The arrangement for the pieces of the magnetic member in the manner as described hereinabove can provide broader input impedance characteristics because the effective permittivity and the effective permeability can be varied with the thickness of each of the pieces of the magnetic member.

The broad-band radio wave absorber according to the present invention can be employed appropriately for a wall material for the radio wave darkroom. In addition, when the reflecting plate is composed of material plate having a great number of small through holes or wire-net structure, the broad-band radio wave absorber according to the present invention is suitable for illumination within rooms and likely to implement air conditioning and it can withstand a large quantity of electric power by forcible air conditioning.

Other objects, features and advantages of the present invention will become apparent in the course of the description of the preferred embodiments, which follows, with reference to the accompanying drawings.

DESCRIPTION OF THE PREFERRED EMBODIMENTS

Figure 1:
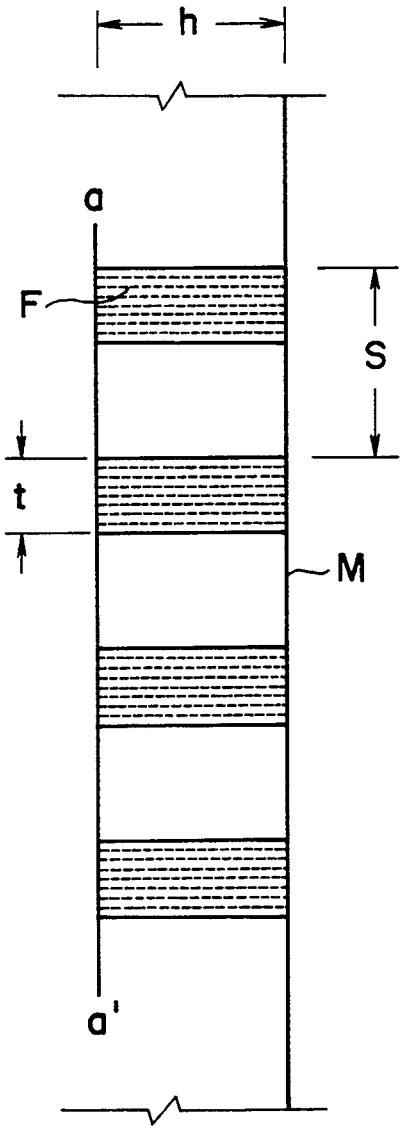
FIG. 1 is a sectional view showing a structure of a basic broad-band radio wave absorber for describing the principle of an embodiment of the present invention.

The present invention will be described more in detail with reference to the accompanying drawings. In the drawings, the members having the identical function are provided with the identical reference symbols for brevity of explanation.

The broad-band radio wave absorber according to an embodiment of the present invention is structured in such a manner that pieces of the magnetic member are disposed on a reflecting plate made of a conductive metal parallel to each other or in a crosswise way in a recurring fashion. Each of the pieces of the magnetic member is disposed in a relationship spaced from the adjacent pieces of the magnetic member by a predetermined distance. A detailed description will then be made of the broad-band radio wave absorber according to the embodiment of the present invention on the basis of the characteristics of those as shown in FIGS. 21A and 21B which have the representative structures of the broad-band radio wave absorbers according to the present invention.

Figure 17A:
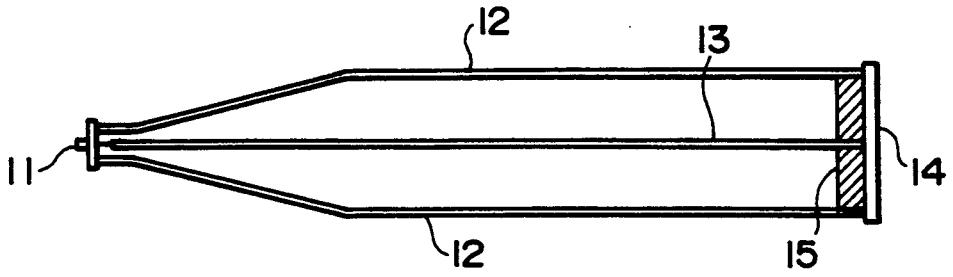
FIG. 17A is a longitudinally sectional view showing a structure of tri-plate lines to be employed for measurement of a sample.
Figure 17B:
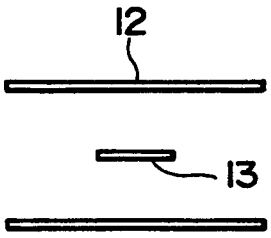
FIG. 17B is a transversely sectional view of FIG. 17A.
Figure 18:
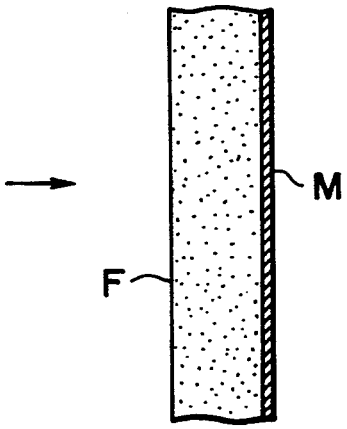
FIG. 18 is a sectional view showing a structure of a basic radio wave ferrite absorber.
Figure 19:
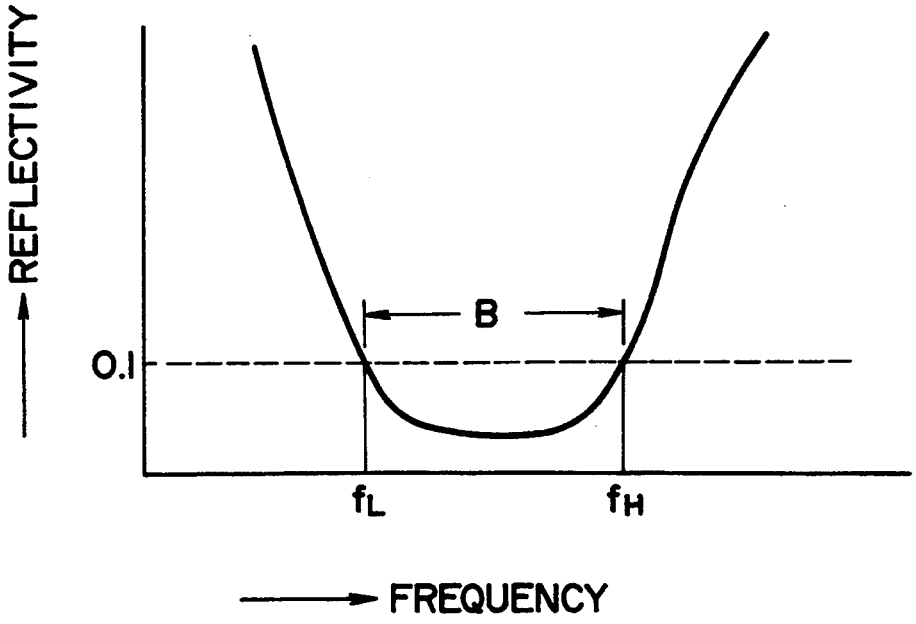
FIG. 19 is a graph showing the characteristic of reflectivity of the basic ferrite tile absorber of FIG. 18.
Figure 20:
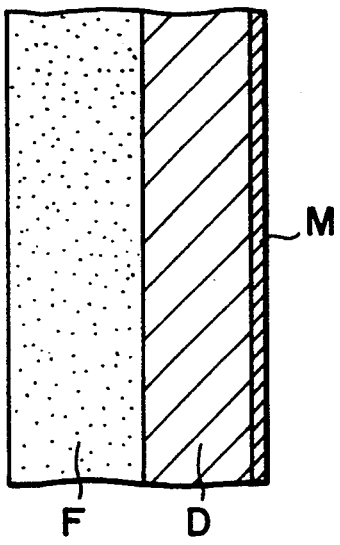
FIG. 20 is a sectional view showing an example of a broad-band radio wave ferrite absorber.

It is noted herein that the characteristics of the broad-band radio wave absorbers according to the embodiments of the present invention as will be described hereinafter indicate the results of experiment obtained on the basis of a TEM wave by using tri-plate transmission line as shown in FIGS. 17A and 17B. In FIGS. 17A and 17B, reference numeral 11 stands for an input connector, reference numeral 12 for an exterior flat plate made of a conductive material, reference numeral 13 for an interior flat plate made of a conductive material, reference numeral 14 for a reflecting plate made of a conductive metal, and reference numeral 15 for a sample to be measured. The characteristic impedance of the tri-plate transmission line is 50 ohms.

Figure 21A:
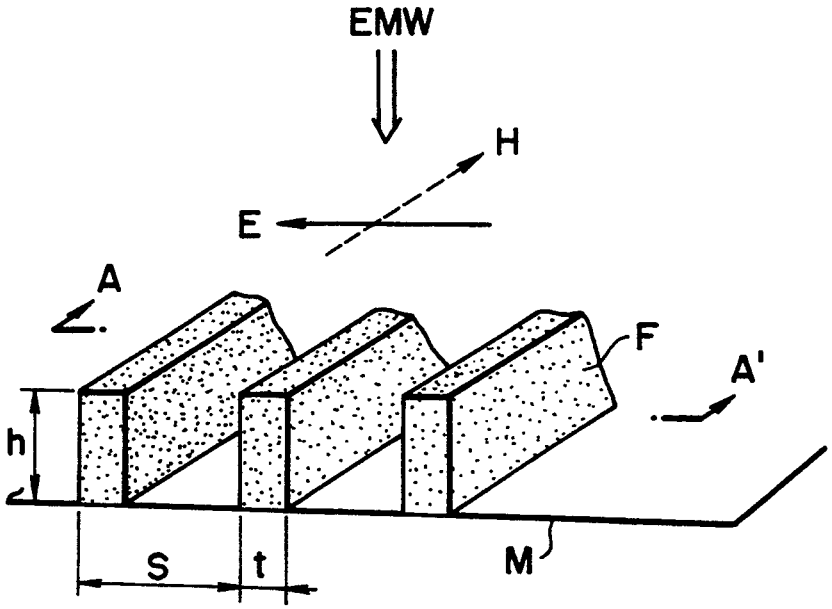
FIG. 21A is a perspective view showing another example of a broad-band radio wave ferrite absorber.
Figure 21B:
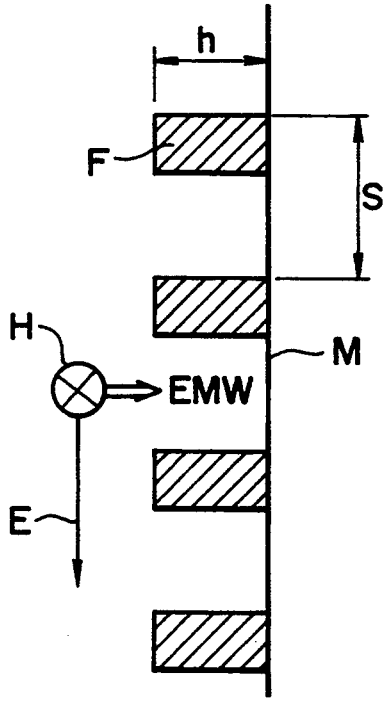
FIG. 21B is a sectional view showing the structure of the broad-band radio wave ferrite absorber of FIG. 21A.

FIG. 1 is the sectional view showing the structure of the basic broad-band radio wave absorber according to the embodiment of the present invention and this broad-band radio wave absorber is the same as shown in FIGS. 21A and 21B. Each of the pieces of the ferrites F having a height h and a thickness t is disposed on the reflecting plate M in a relationship spaced away from the adjacent pieces thereof at a predetermined interval S from the adjacent pieces thereof. The material of the ferrites F is a sintered ferrite of a NiZn type, having a permeability of 2,200, thickness t of 7.5 mm, height h of 5 to 30 mm, and interval S of 20 mm.

Figure 2:
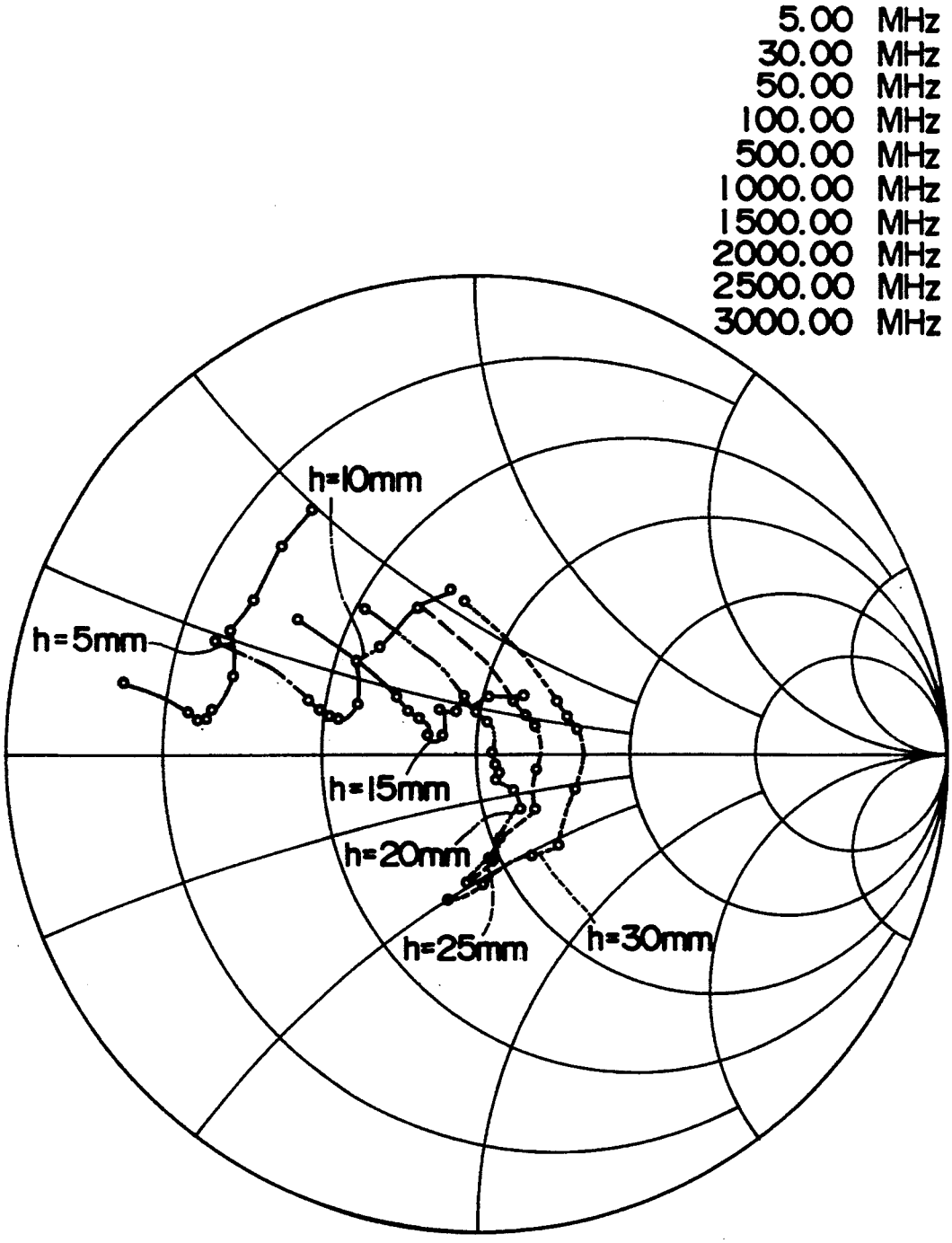
FIG. 2 is a view showing the characteristic impedance vs. height of the radio wave absorber of FIG. 1.

FIG. 2 is the Smith impedance chart showing a relationship between the input impedance measured at the surface (a—a') of the radio wave absorber of FIG. 1 toward and the frequency, while the height h of each of the pieces of the ferrite member is varied in a stepwise manner by 5 mm from 5 mm to 30 mm and the impedance to be measured are normalized with the characteristic impedance of 50 ohms.

Figure 3:
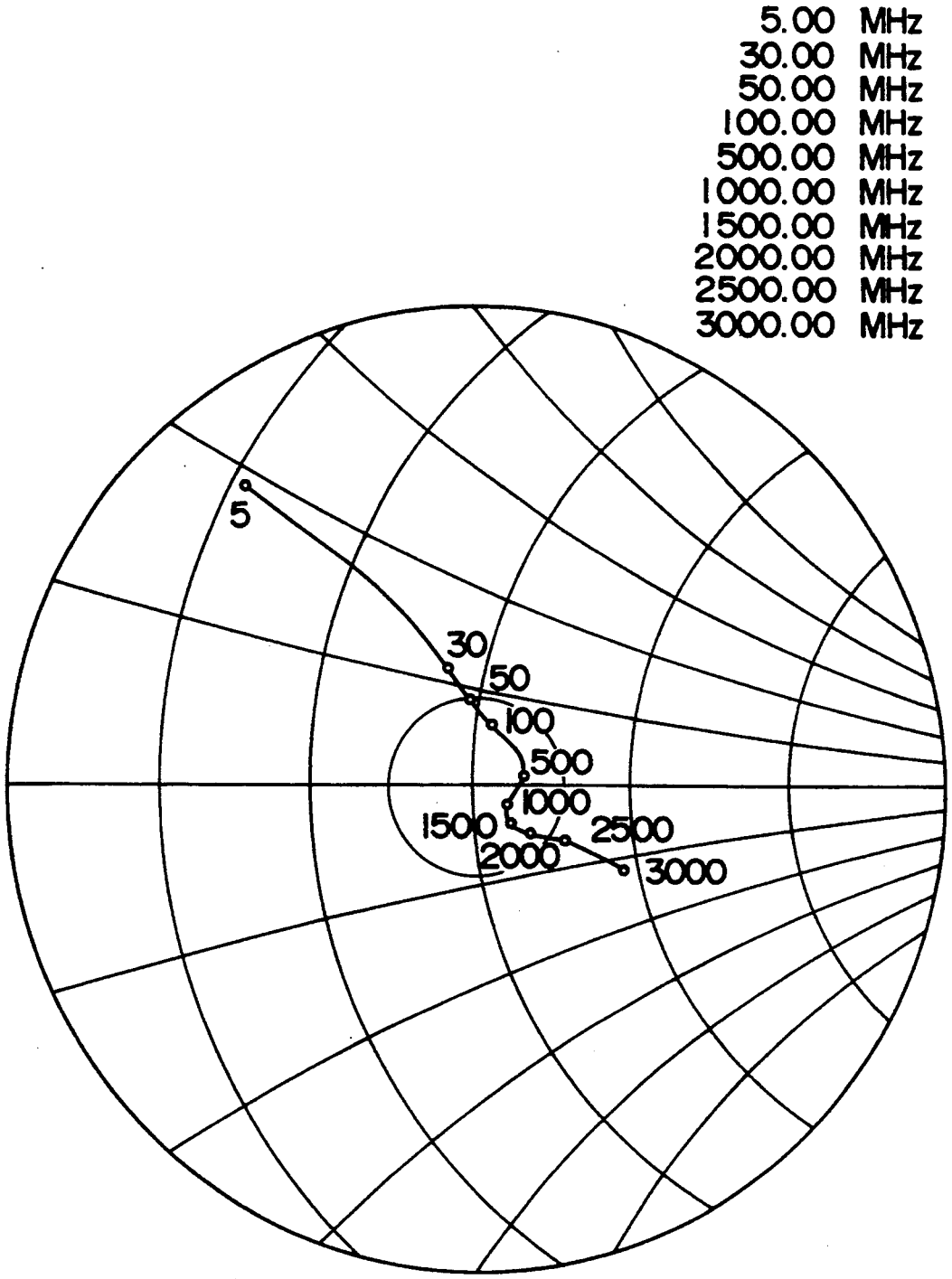
FIG. 3 is the input impedance of radio wave absorber or FIG. 1 when its height h is 20 mm.

FIG. 3 shows the instance where the band becomes broadest in FIG. 2, in which h=20 mm in the range in which the reflectivity is −20 dB or lower, and the frequency band exists in a circle having the standing wave ratio (SWR) of 1.2 in FIG. 3. The frequency band ranges from 50 MHz to 2,400 MHz.

Figure 4:
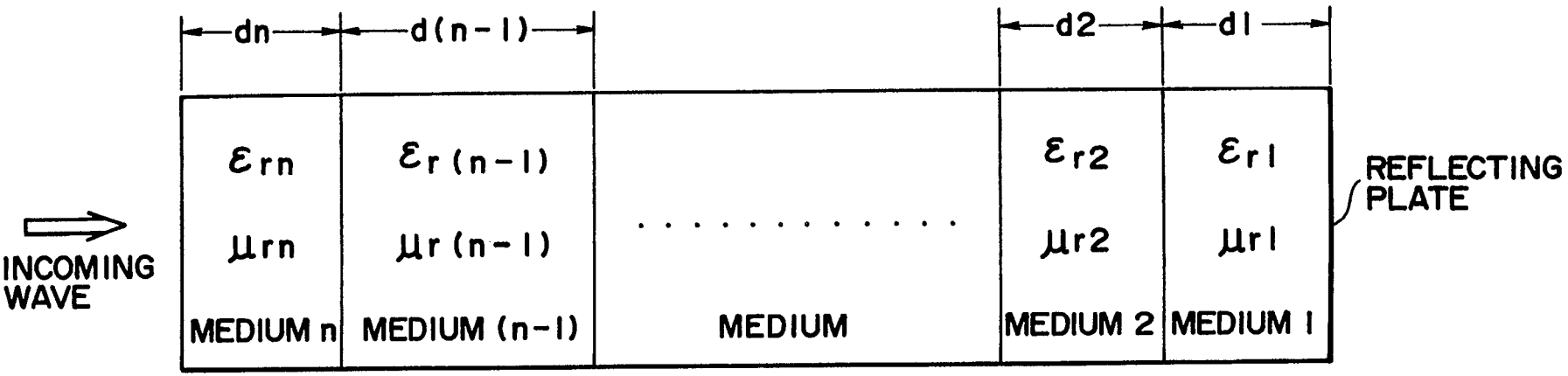
FIG. 4 is a schematic representation for describing the principle of the multi-layer absorber.

The characteristics of the radio wave absorber as shown in FIGS. 2 and 3 are measured using by tri-plate transmission line. FIG. 4 is a generalized representation of the radio wave absorber in which a medium exists within the space over the reflecting plate M. Each of the media has a relative permeability as indicated by $\mu_{r1}, \ldots, \mu_{rn}$, a relative dielectric constant as indicated by $\epsilon_{r1}, \ldots, \epsilon_{rn}$, and a height as indicated by $d_1, \ldots, d_n$, respectively, and the respective media, as indicated by 1, . . . , n, are superimposed in this order toward the direction of incident wave from the reflecting plate M.

When attention is paid to a plane wave, it is known that the issue of the media existing within the space and the behavior of the media can approximate to a state of the propagation of the voltage and the current on a distributed constant circuit so that they can be handled as an issue of the transmission lines.

Figure 5:
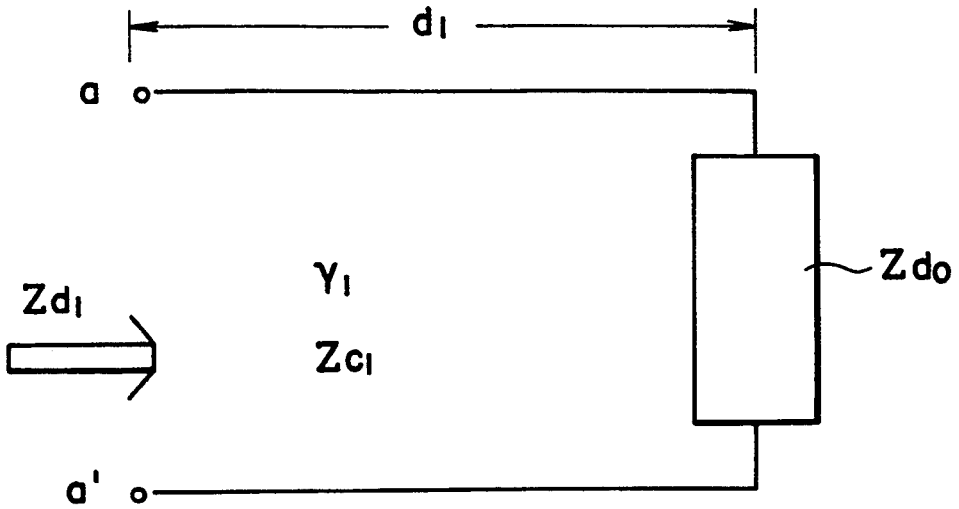
FIG. 5 is a schematic representation for describing the transmission lines.

When a load impedance $Zd_0$ is connected with a line of a characteristic impedance $Zc_1$ as shown in FIG. 5, the input impedance $Zd_1$ at from the point (a—a') remote away in a distance $d_1$ from the load can be represented, as is well known in the electrical engineering, by the following formula (4):

$$Zd_1 = Zc_1 \times \frac{Zd_0 + Zc_1 \tanh \gamma_1 d_1}{Zc_1 + Zd_0 \tanh \gamma_1 d_1}$$

where $\gamma_1$ is a propagation constant of the line.

When the load impedance $Zd_0$ is in such a short-circuit state as the reflecting plate, the load impedance $Zd_0$ is zero. Thus, the formula (4) gives the following formula (5):

$$Zd_1 = Zc_1 \tan h\gamma_1 d_1.$$

Figure 6A:
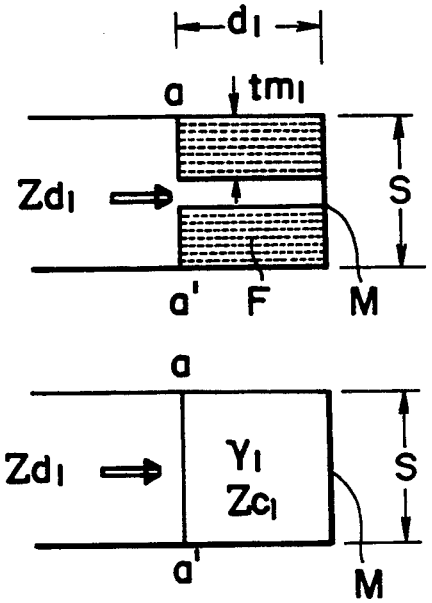
FIG. 6A is a schematic representation for describing the principle of the present invention.

It can be noted herein that the characteristics as indicated in FIG. 2 is equivalent to the instance where the distance $d_1$ varies in the formula (5), and the state in this case is shown in FIG. 6A so as to correspond to part of FIG. 1.

Figure 6B:
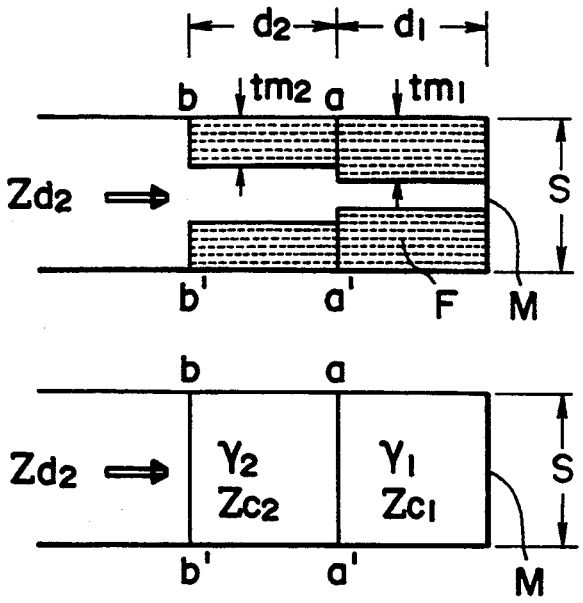
FIG. 6B is a schematic representation for describing the principle of the present invention.

Further, as shown in FIG. 6B, a transmission line having the different characteristic is added to the structure of the arrangement as shown in FIG. 6A, the input impedance $Zd_2$, toward the reflecting plate M at the surface b—b' of a second layer of the ferrite piece F superimposed on the first layer thereof, can be represented by the following formula (6):

$$Zd_2 = Zc_2 \times \frac{Zd_1 + Zc_2 \tanh \gamma_2 d_2}{Zc_2 + Zd_1 \tanh \gamma_2 d_2}$$

where $Zc_2$ is the characteristic impedance of the line added;

$\gamma_2$ is a propagation constant of the line added; and $d_2$ is the height of the second ferrite piece.

Figure 6C:
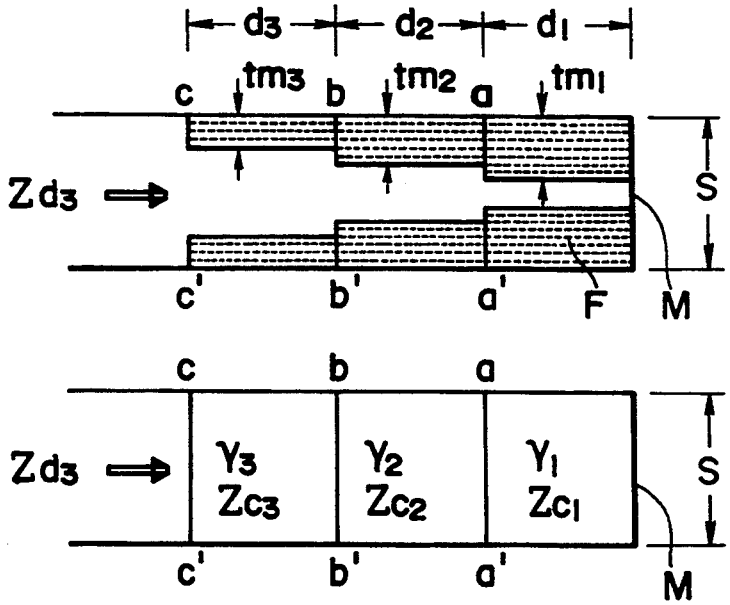
FIG. 6C is a schematic representation for describing the principle of the present invention.

Likewise, as shown in FIG. 6C, the transmission line having the different characteristic is added to the structure of the arrangement as shown in FIG. 6B, the input impedance $Zd_3$, toward the reflecting plate M at the surface c—c' of a third layer of the ferrite piece F superimposed on the second layer thereof, can be represented by the following formula (7):

$$Zd_3 = Zc_3 \times \frac{Zd_2 + Zc_3 \tanh \gamma_3 d_3}{Zc_3 + Zd_2 \tanh \gamma_3 d_3}$$

where $Zc_3$ is the characteristic impedance of the line added;

$\gamma_3$ is a propagation constant of the line added; and $d_3$ is the height of the third ferrite piece.

Likewise, a line having the different characteristics is further added to the formula where the input impedance $Zd_{n-1}$ of a (n-1) stage is given, and the input impedance $Zd_n$ of the n-stage can be represented by the following formula (8):

$$Zd_n = Zc_n x \times \frac{Zd_{n-1} + Zc_n \tanh \gamma_n d_n}{Zc_n + Zd_{n-1} \tanh \gamma_n d_n}$$

where $Zc_n$ is the characteristic impedance of the line of the n-stage;

$\gamma_n$ is a propagation constant of the line of the n-stage; and $d_n$ is the height of the line of the n-stage. Then, when the formula (5) is substituted for the formula (6), the following formula (9) is given:

$$Zd_2 = Zc_2x \times \frac{Zc_1\tanh\gamma_1 d_1 + Zc_2\tanh\gamma_2 d_2}{Zc_2 + Zc_1\tanh\gamma_1 d_1\tanh\gamma_2 d_2}$$

Further, when the formula (9) is substituted for the formula (7), the formula (10) is given as will be described hereinafter.

The formulas (5), (9), and (10) correspond to the input impedances as shown in FIGS. 6A, 6B, and 6C, respectively.

As certain media exist within the space over the reflecting plate M as shown in FIG. 6A, 6B, 6C, the characteristic impedance of the first line, as indicated by reference symbol $Zc_1$, can be represented by the following formula (11):

$$Zc_1 = \sqrt{\frac{\mu_1}{\epsilon_1}} = \sqrt{\frac{\mu_0}{\epsilon_0}}\sqrt{\frac{\mu_{r1}}{\epsilon_{r1}}} = \eta_0\eta_1$$

The propagation constant $\gamma_1$ may be represented by the following formula (12):

$$\gamma_1 = j\omega\sqrt{\mu_1\epsilon_1} = j\omega\sqrt{\mu_0\mu_{r1}\epsilon_0\epsilon_{r1}}$$

Thus, in order to treat the distributed constant line of the first stage, the formula (5) is substituted for the formulas (11) and (12), thereby giving the following formula (13):

$$\widetilde{Zd_1} = \frac{Zd_1}{\eta_0} = \sqrt{\frac{\mu_{r1}}{\epsilon_{r1}}}\tanh j\frac{2\pi d_1}{\lambda}\sqrt{\mu_{r1}\epsilon_{r1}}$$

Likewise, the distributed constant line of the second stage can be represented by the following formula (14):

$$\widetilde{Zd_2} = \eta_2 \times \frac{\eta_1\tanh\gamma_1 d_1 + \eta_2\tanh h_2 d_2}{\eta_2 + \eta_1\tanh\gamma_1 d_1\tanh\gamma_2 d_2}$$

Further, the distributed constant line of the third stage can be represented by the formula (15) as will be described hereinafter.

As is apparent from the aforesaid formulas, it is to be understood that the normalized input impedance can always be represented only by the media impedance $\eta$, the height and the propagation constant $\gamma$, even if the number of the stages of the media would be increased. Hence, in accordance with the present invention, the broadest band can be selected by a combination of the relative permeability $\mu_r$, the relative dielectric constant $\epsilon_r$, and the height of the media.

Generally, the relative permeability $\mu_r$ and the relative dielectric constant $\epsilon_r$ of the ferrite material are represented by the following formulas (18):

$$\mu_r = \mu_{r1} - j\mu_{r2}$$

$$\epsilon_r = \epsilon_{r1} - j\epsilon_{r2}$$

Further, they have a characteristic for dispersing the frequency.

The relative permeability $\mu_r$ of the sintered ferrite of the NiZn type is generally set in such a manner that the real number of relative permeability $\mu_{r1}$ is in the range from approximately 10 to 2,500 depending on its properties and the imaginary part of relative permeability $j\mu_{r2}$ becomes larger or smaller as the real part $\mu_{r1}$ is larger or smaller, respectively. However, when the space between the adjacent pieces of the ferrite members is provided, as shown in FIG. 1, the relative permeability $\mu_r$ of the media which is seen from the line a—a' in FIG. 1 toward the reflecting plate M may be varied in such a manner that an apparent relative permeability (an equivalent permeability) varies with the thickness of the magnetic material compared with the relative permeability at the time when the media is filled with magnetic material. The same thing can be said of the imaginary part $j\mu_{r2}$. It can be noted as a matter of course that, if the magnetic material has the same properties, the apparent relative permeability $\mu_r$ becomes lower as the thickness t is smaller, on the apparent one hand, and the relative permeability $\mu_r$ reaches its maximum value which is the same value of the material itself when the thickness t is equal to the distance S (t=S).

Further, when the apparent relative dielectric constant (equivalent relative dielectric constant) is the same, the relative dielectric constant $\epsilon_{r1}$ of sintered ferrite is approximately 15 when t=S, and the real part $\epsilon_{r1}$ is reduced to 1.2 when t=6.5 mm, and S=20 mm.

Figure 22:
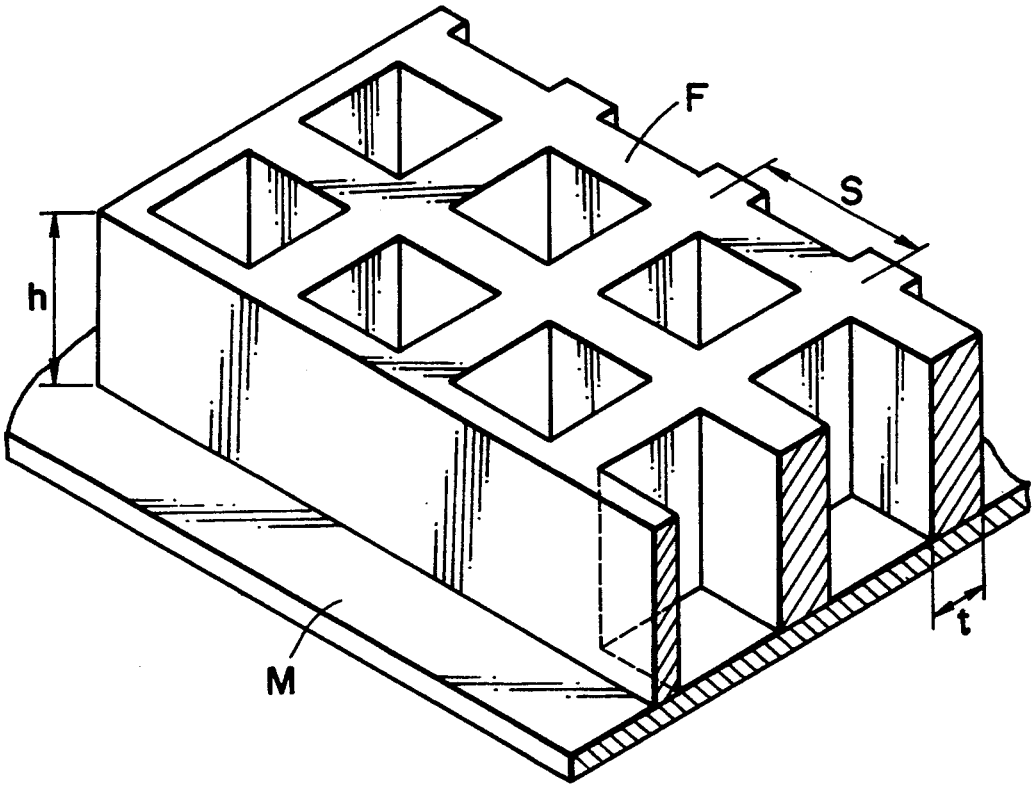
FIG. 22 is a perspective view showing a further example of a broad-band radio wave ferrite absorber.

It should be noted, however, that the arrangement for the structure in a lattice form as shown in FIG. 22 can give the effective apparent relative dielectric constant of t=, even if t=6.5 mm, and S=20 mm. Furthermore, if a conductive material is interposed between the adjacent pieces of the ferrite member, the effective apparent relative dielectric constant is increased to a great extent.

On the other hand, generally, the relative dielectric constant $\epsilon_r$ of the sintered ferrite of the NiZn type is such that the real part $\epsilon_{r1}$ is said to be almost constant with respect to the frequency and the imaginary part $\epsilon_{r2}$ is said to be very small. It should be noted herein that the broad-band radio wave absorber according to the present invention can control its dielectric constant to a desired value because a combination of the magnetic sections with the space sections is arranged in a regular relationship, while the broad-band radio wave absorber with the ferrite members disposed in a tile arrangement can give a relatively high dielectric constant of approximately 15.

EXAMPLE 1

Figure 7:
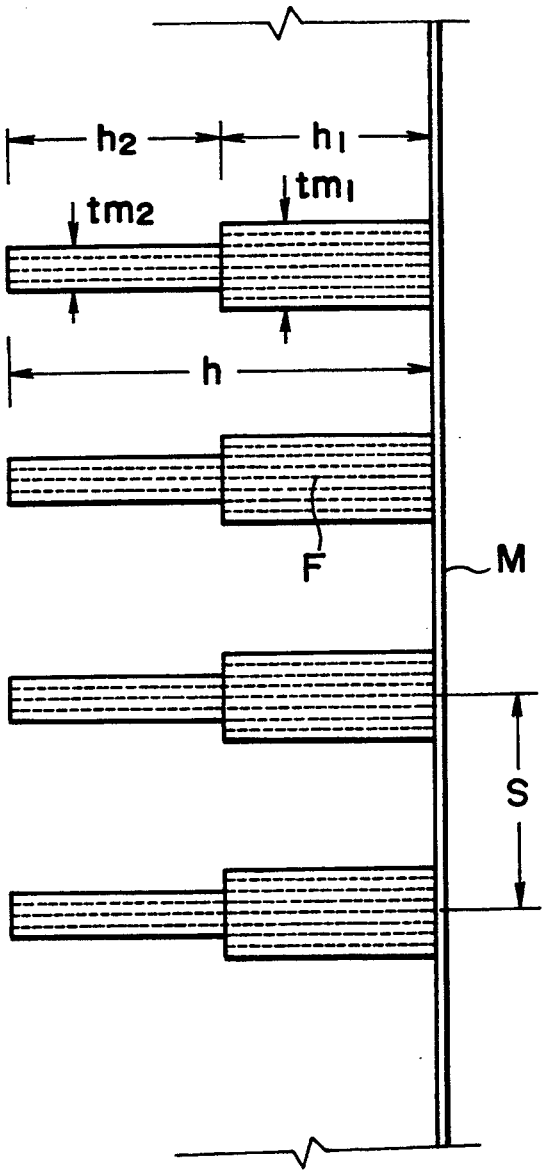
FIG. 7 is a sectional view showing a structure of a broad-band radio wave absorber of a fin type according to Example 1 of the present invention.
Figure 8:
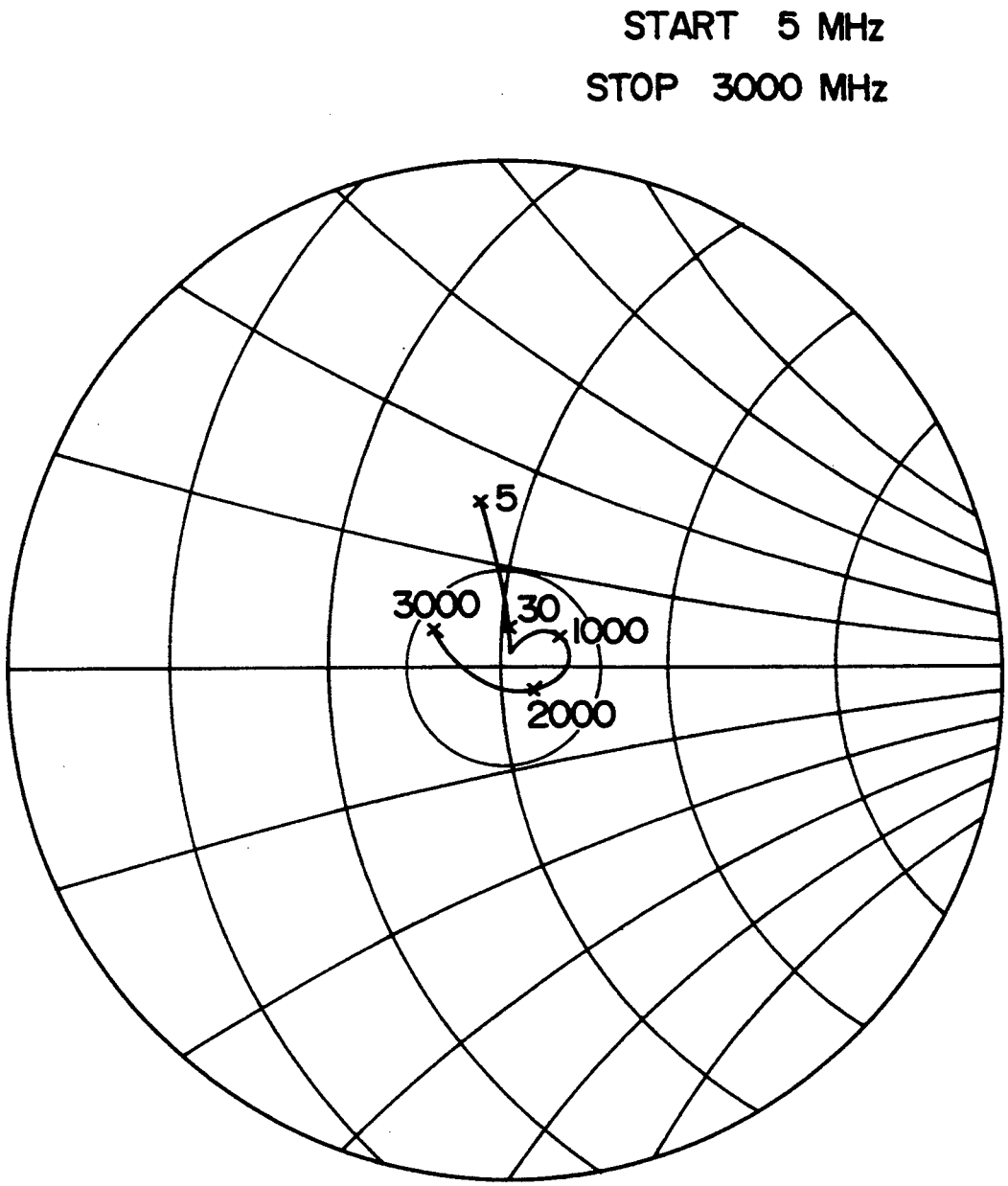
FIG. 8 is a view showing the input impedance vs. frequency of an embodiment of the present invention.

FIG. 7 is the sectional view showing the structure of the broad-band radio wave absorber of the fin type according to the first embodiment of the present invention. As shown in FIG. 7, the broad-band radio wave absorber of the fin type is arranged in such a manner that a second step or layer of each piece of a ferrite material F is disposed or superimposed on a first step or layer thereof disposed on the reflecting plate M. The ferrite material F is composed of sintered ferrite of a NiZn type having a relative permeability of 1,500 at the time of a direct current, the first step or layer of the piece of the ferrite material F has a height $h_1$ of 7 mm and a thickness $t_{m1}$ of 9.5 mm, the second step or layer of the piece of the ferrite material F has a height $h_2$ of 12 mm and a thickness $t_{m2}$ of 6.5 mm, and the second step or layer of the piece of the ferrite material is disposed to the first step or layer of the piece of the ferrite material and disposed on the reflecting plate away at an interval of 20 mm. FIG. 8 shows the chart of the normalized impedance on the surface of the ferrite material shown in FIG. 7. As a result, the broad-band radio wave absorber prepared in Example 1 gives the SWR of 1.2 or lower over the range of frequencies of 30 MHz to 3,000 MHz.

Formula (10):

$$Zd_3 = Zc_3 \times \frac{Zc_1Zc_2\tanh\gamma_1d_1 + Zc_2^2\tanh\gamma_2d_2 + Zc_2Zc_3\tanh\gamma_3d_3 + Zc_1Zc_3\tanh\gamma_1d_1\tanh\gamma_2d_2\tanh\gamma_3d_3}{Zc_2Zc_3 + Zc_1ZC_3\tanh\gamma_1d_1\tanh\gamma_2d_2 + Zc_1Zc_2\tanh\gamma_1d_1\tanh\gamma_3d_3 + Zc_2^2\tanh\gamma_2d_2\tanh\gamma_3d_3}$$

Formula (15):

$$\widetilde{Zd_3} = \eta_3 \times \frac{\eta_1\eta_2\tanh\gamma_1d_1 + \eta_2^2\tanh\gamma_2d_2 + \eta_2\eta_3\tanh\gamma_3d_3 + \eta_1\eta_3\tanh\gamma_1d_1\tanh\gamma_2d_2\tanh\gamma_3d_3}{\eta_2\eta_3 + \eta_1\eta_3\tanh\gamma_1d_1\tanh\gamma_2d_2 + \eta_1\eta_2\tanh\gamma_1d_1\tanh\gamma_3d_3 + \eta_2^2\tanh\gamma_2d_2\tanh\gamma_3d_3}$$

EXAMPLE 2

Figure 9A:
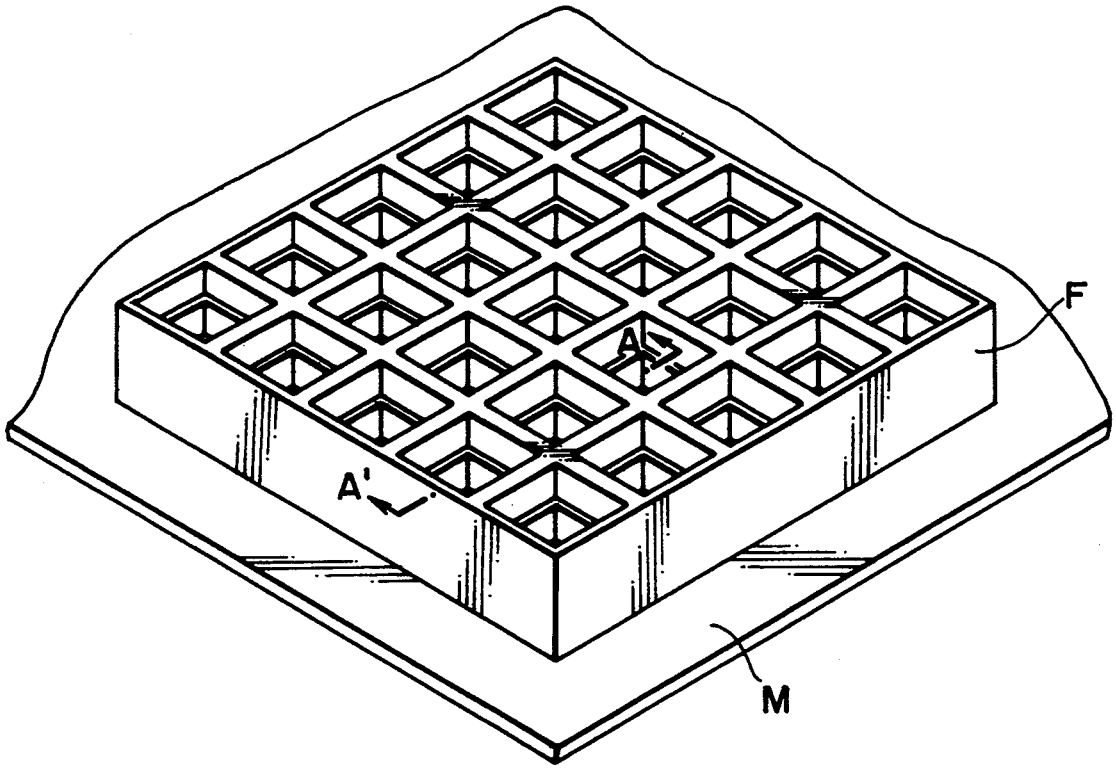
FIG. 9A is a perspective view showing a structure of a broad-band radio wave absorber of a lattice type according to Example 2 of the present invention.
Figure 9B:
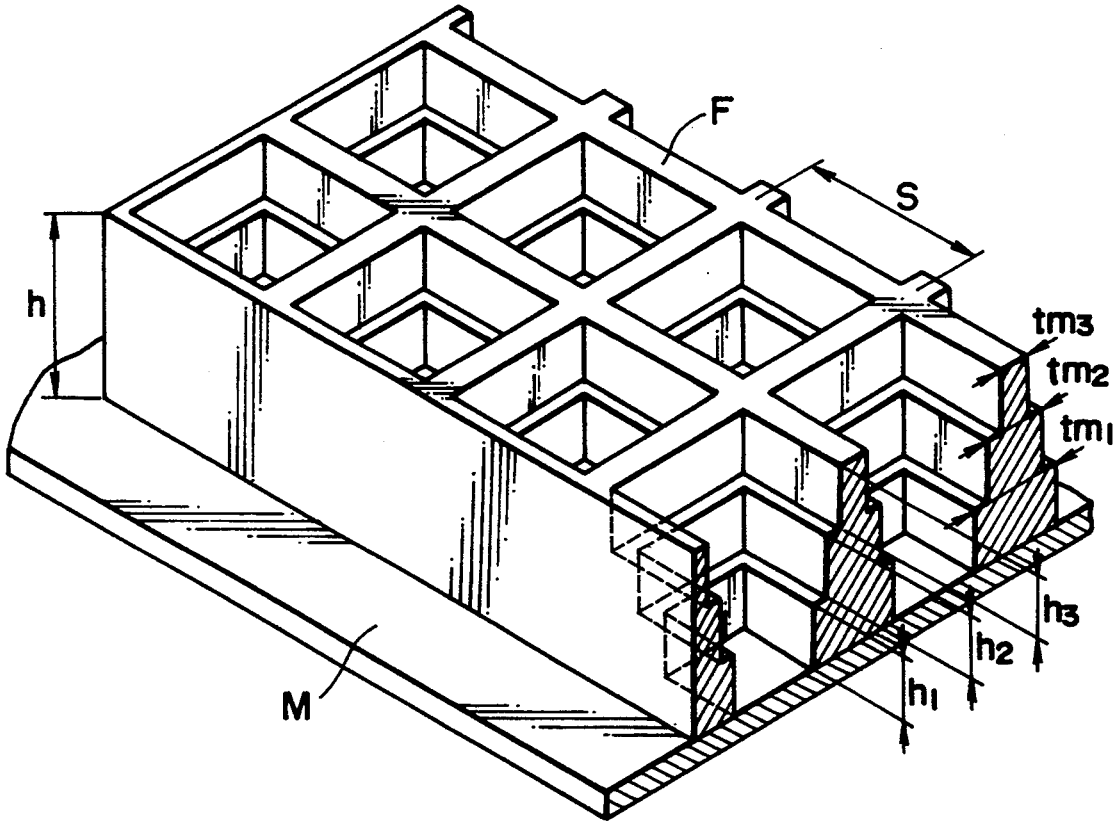
FIG. 9B is a sectional view taken along line A—A′ of FIG. 9A.

FIG. 9A shows the structure of the broad-band radio wave absorber of the lattice type according to a second embodiment of the present invention, and FIG. 9B shows the section of the broad-band radio wave absorber of FIG. 9A. As shown in FIGS. 9A and 9B, the broad-band radio wave absorber of the lattice type is structured in such a manner that each of pieces of ferrite material is disposed in three layers or in three steps on the reflecting plate M. The ferrite material used is composed of a sintered ferrite of a NiZn type having a relative permeability of 1,500; a first step or layer of each piece of the ferrite material is disposed on the reflecting plate M has a height $h_1$ of 4 mm and a thickness $t_{m1}$ of 10 mm; a second layer or step of the piece of the ferrite material superimposed on the first step or layer thereof had a height $h_2$ of 5 mm and a thickness $t_{m2}$ of 6.5 mm; a third step or layer of each of the pieces of the ferrite material are superimposed on the second step or layer of the piece thereof has a height $h_3$ of 5 mm and a thickness $t_{m3}$ of 4.5 mm; and a distance S between the middle of the piece of the ferrite material and the middle of the adjacent piece thereof is set to 20 mm. In other words, the piece of the ferrite material F is divided into three layers of the ferrite material or disposed into three steps thereof, each having the height $h_1$, $h_2$, and $h_3$.

Figure 10:
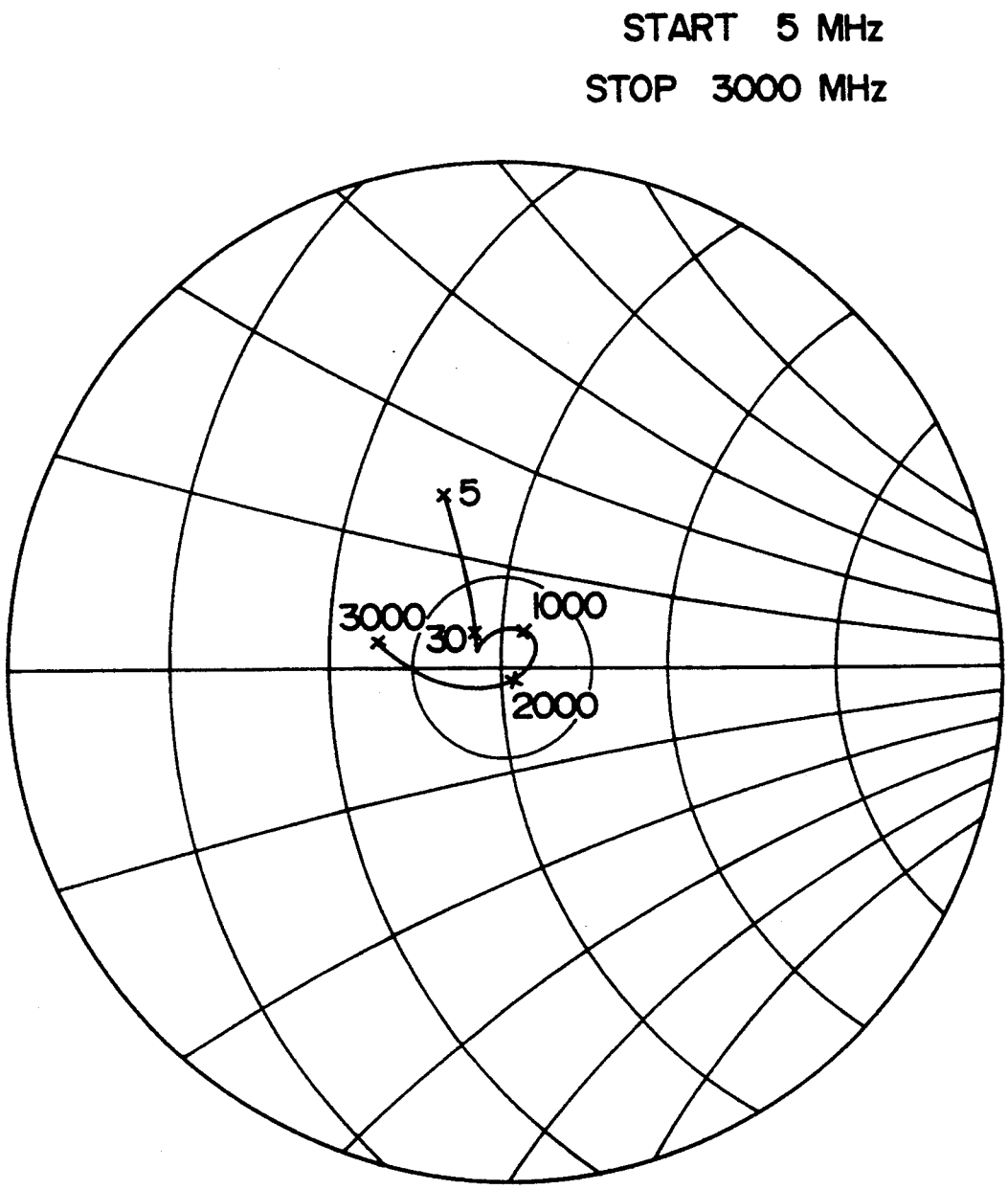
FIG. 10 is a chart showing normalized input impedance vs. frequency of an absorber according to Example 2 of the present invention.

The normalized input impedance in this case on the surface of the ferrite material is shown in FIG. 10. It is thus found in FIG. 10 that the impedance of the broad-band radio wave absorber is matched to 30 MHz to 2,600 MHz in the SWR of 1.2 or lower.

EXAMPLE 3

Figure 11:
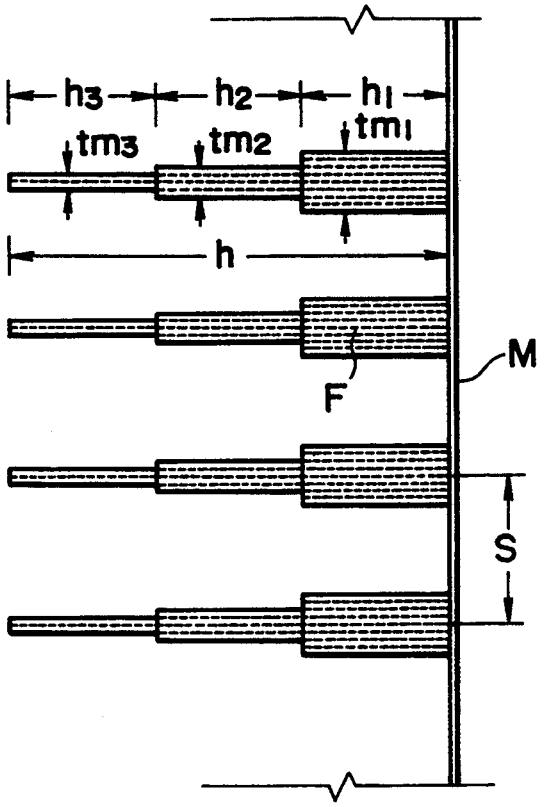
FIG. 11 is a sectional view showing a structure of another broad-band radio wave absorber of a fin type according to Example 3 of the present invention.
Figure 12:
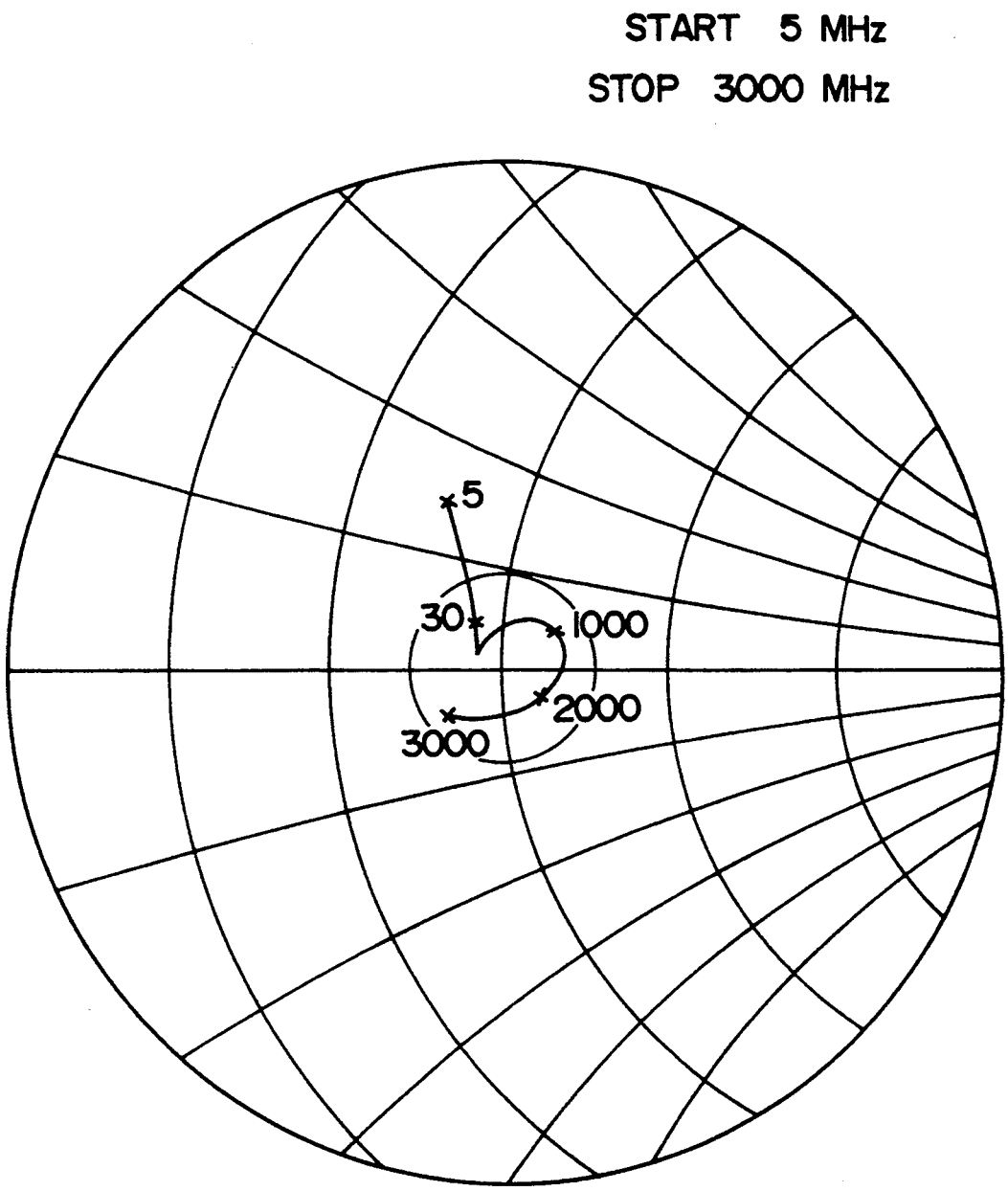
FIG. 12 is a chart showing normalized input impedance vs. frequency of an absorber according to Example 3 of the present invention.

FIG. 11 shows the structure of the broad-band radio wave absorber of the fin type according to a third embodiment of the present invention. As shown in FIG. 11, the broad-band radio wave absorber of the fin type is structured in such a manner that a piece of ferrite material is divided into three smaller layers or composed of three steps and is disposed on the reflecting plate M. The ferrite material used is composed of a sintered ferrite of a NiZn type having a relative permeability of 1,500; a first step or layer of each of the pieces of the ferrite material is disposed on the reflecting plate M has a height $h_1$ of 6 mm and a thickness $t_{m1}$ of 8 mm; a second step or layer of the piece of the ferrite material is superimposed on the first step or layer of the piece of the ferrite material has a height $h_2$ of 6 mm and a thickness $t_{m2}$ of 7 mm; a third step or layer of the piece of the ferrite material is superimposed on the second piece thereof has a height $h_3$ of 5 mm and a thickness $t_{m3}$ of 6.5 mm; and a distance S between the middle of the piece of the ferrite material and the middle of the adjacent piece thereof is set to 20 mm. The normalized impedance in this case on the surface of the ferrite material is shown in FIG. 12. It is thus found in FIG. 12 that the broad-band radio wave absorber gives the absorption characteristic such as the reflectivity of −20 dB or lower over the range of frequencies of 30 MHz to 3,000 MHz.

EXAMPLE 4

Figure 13A:
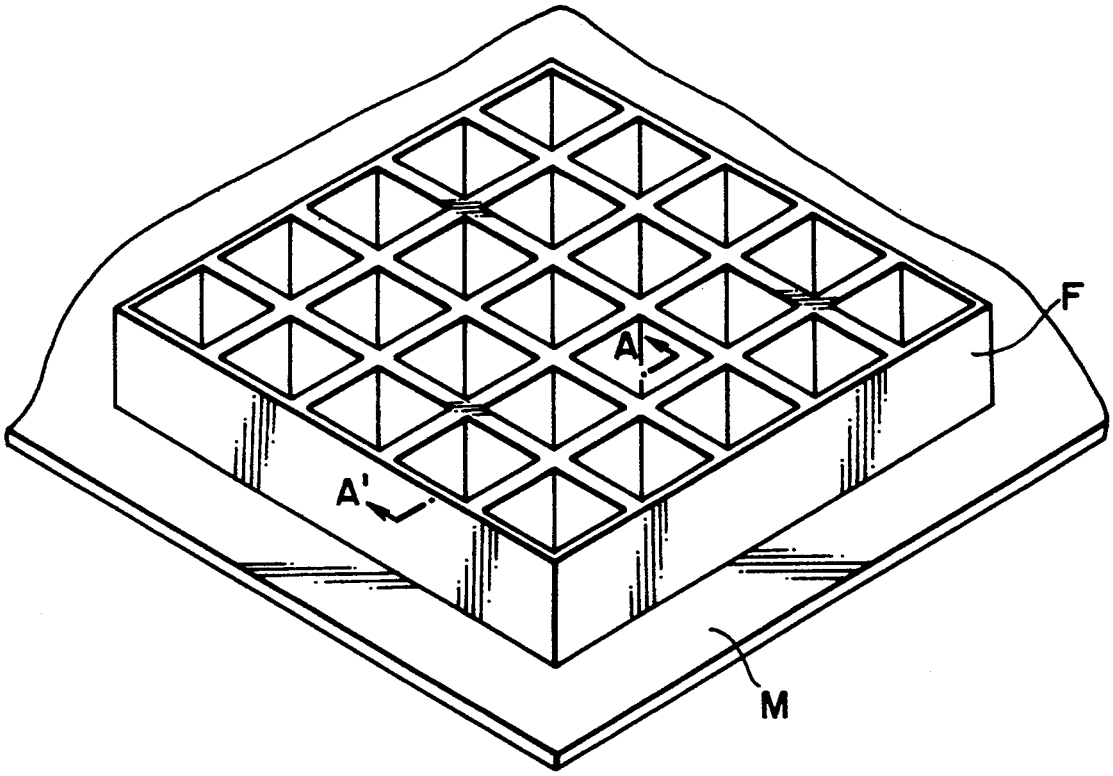
FIG. 13A is a perspective view showing a structure of another broad-band radio wave absorber of a lattice type according to Example 4 of the present invention.
Figure 13B:
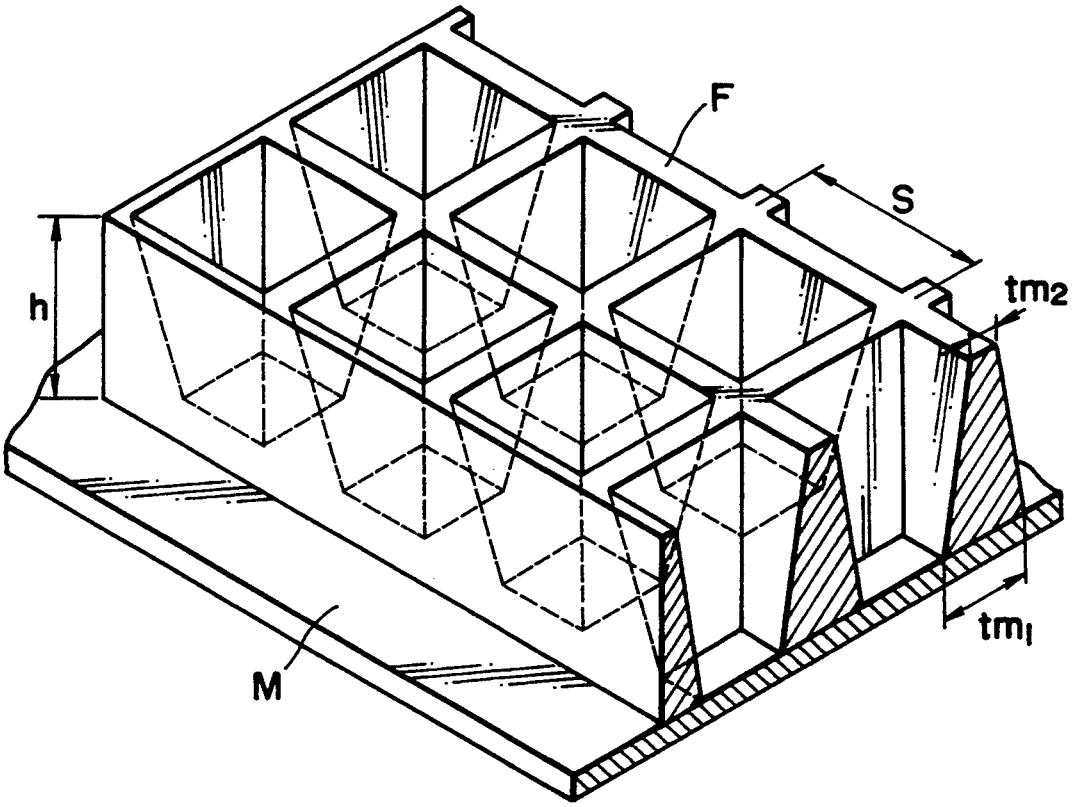
FIG. 13B is a sectional view of taken along line A—A′ of FIG. 13A.
Figure 14:
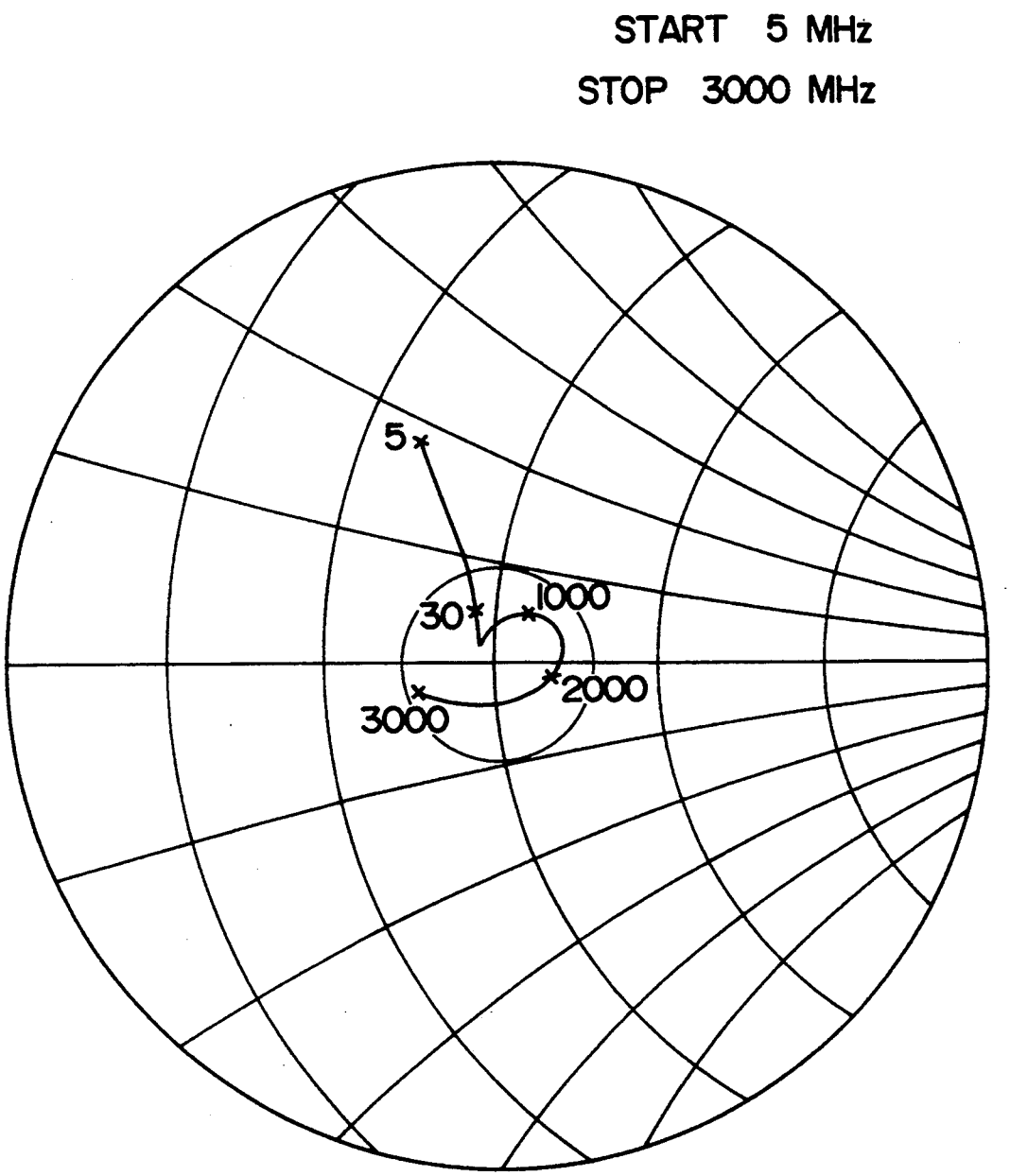
FIG. 14 is a chart showing normalized impedance on the surface of the ferrite according to Example 4 of the present invention.

FIG. 13A shows the structure of the broad-band radio wave absorber of the lattice type according to another embodiment of the present invention, and FIG. 13B shows the section of the ferrite material for the broad-band radio wave absorber of FIG. 13A. As shown specifically in FIG. 13B, the piece of the ferrite material F having a total height h is so arranged as for its thickness to become gradually smaller from its bottom towards its top. The ferrite material F used is composed of a sintered ferrite of a NiZn type having a relative permeability of 2,500 and each piece of the ferrite material is made gradually smaller from 10 mm in thickness at the bottom, as indicated by $t_{m1}$, to 4 mm in thickness at the top, as indicated by $t_{m2}$. A distance S between the middle of the piece of the ferrite material and the middle of the adjacent piece thereof is set to 20 mm. The normalized impedance in this case on the surface of the ferrite material is shown in FIG. 14. It is thus found in FIG. 14 that the broad-band radio wave absorber gives the absorption characteristic such as the amount of reflection of −20 dB or lower over the range of frequencies of 30 MHz to 3,000 MHz.

As will be understood from the description as made hereinabove, the broad-band radio wave absorbers of the fin type and of the lattice type according to the embodiments of the present invention can readily provide a characteristic of input impedance with a broader band by providing a large number of regularly recurring units, each consisting of a space section and a magnetic section, a height h of the magnetic section is divided into smaller sections, as well as an effective dielectric constant and the apparent permeability of each smaller section is able to select by thickness of magnetic member.

Further, as the radio wave absorber according to the present invention is provided with spatial sections, it can conveniently be employed as a wall material for a radio wave darkroom for radio waves, for example, to prevent undesired reflection from the metallic surfaces in the dark room, it is desirable that the equipment of lighting and/or the vent of the air duct is provided in the back of the reflector, by using a wire net or a metallic plate having through holes as the reflecting plate. In such a case, the air or the light can pass through from the back of the reflector through the top of the absorber, it may be effectively air cooling by passing air through the absorber, good illumination for rooms as well as withstand a large amount of electric power by forcible air freezing.

Figure 15:
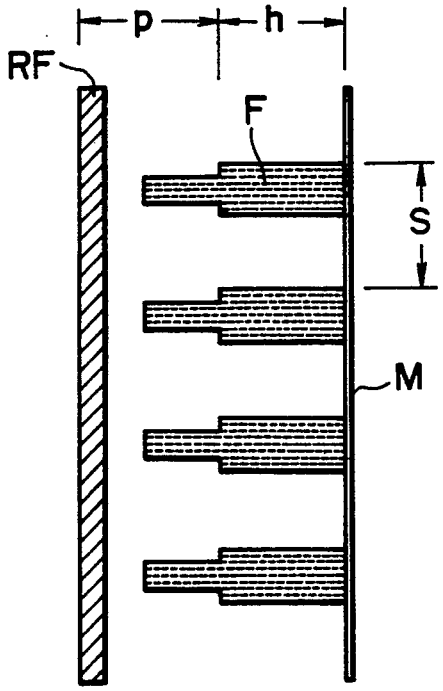
FIG. 15 is a sectional view showing an example of application according to the present invention.
Figure 16:
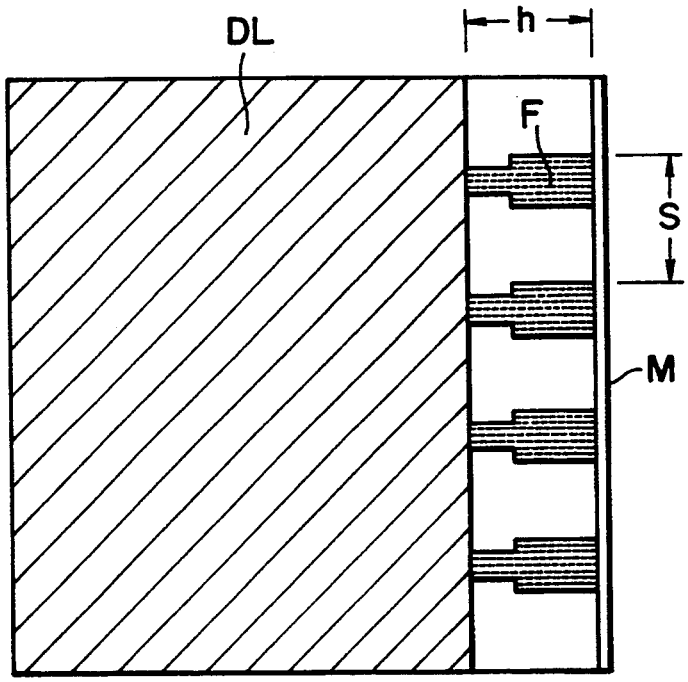
FIG. 16 is a sectional view showing another example of application according to the present invention.

The broad-band radio wave absorber according to the present invention can further make its band broader by providing it with a membrane RF of a magnetic material having a low degree of permeability in the direction of incident wave, as shown in FIG. 15. In addition, the broad-band radio wave absorber is provided at its front portion with a piece of loss dielectric material DL as shown in FIG. 16. In each case, since the broad-band radio wave absorber (indicated by FIGS. 15 and 16) makes it band broader, the distance between the magnetic membrane (RF) and the surface of the absorbing body (F) or the height of the loss dielectric material (DL) can be reduced. Hence, the broad-band radio wave absorber according to the present invention can reduce its entire height, as compared with conventional broad-band radio wave absorbers with a magnetic membrane or a loss dielectric material added thereto.

What is claimed is:

1. A broad-band radio wave absorber comprising a plurality of pieces of a ferrite magnetic member disposed in either of a parallel manner to each other or in a crosswise manner on a reflecting plate, each of said pieces of said ferrite magnetic member comprising a plurality of portions superimposed in turn in a stepwise manner;

wherein each of said pieces of said ferrite magnetic member is configured such that a thickness of each portion thereof becomes smaller from the bottom of each of said pieces towards the top of the respective piece and the total height of each of said pieces of said ferrite magnetic member is equal to or longer than the thickness of the lowest portion of the respective piece of said ferrite magnetic member;

wherein each of said pieces of said ferrite magnetic member is disposed separately from an adjacent piece of said ferrite magnetic member pieces at such a distance being longer than the thickness of the lowest portion of the respective piece of said ferrite magnetic member; and wherein all of the portions of the piece of the ferrite magnetic member are composed of sintered ferrite material.

2. A broad-band radio wave absorber as claimed in claim 1, wherein the number of the portions in each of said pieces of said ferrite magnetic member is three, and a height of an upper portion of the respective piece is set to be 30 mm or less, a height of a middle portion of the respective piece is set to be 30 mm or less, and a height of a lower portion of the respective piece is set to be 15 mm or less.

3. A broad-band radio wave absorber comprising a plurality of pieces of a ferrite magnetic member disposed in either of a parallel manner to each other or in a crosswise manner on a reflecting plate, each of said pieces of said ferrite magnetic member comprising a plurality of portions superimposed in turn in a stepwise manner;

wherein each of said pieces of said ferrite magnetic member is configured such that a thickness of each portion thereof becomes smaller from the bottom of each of said pieces towards the top of the respective piece and the total height of each of said pieces of said ferrite magnetic member is equal to or longer than the thickness of the lowest portion of the respective piece of said ferrite magnetic member;

wherein each of said pieces of said ferrite magnetic member is disposed separately from an adjacent piece of said ferrite magnetic member pieces at such a distance being longer than the thickness of the lowest portion of the respective piece of said ferrite magnetic member; and wherein all of the portions of the piece of the ferrite magnetic member are composed of sintered ferrite material, and wherein each of said pieces of said ferrite magnetic member is configured such that a height of each portion becomes larger from the bottom of the respective piece towards the top of the respective piece.

4. A broad-band radio wave absorber as claimed in claim 3, wherein the number of the portions in each of said pieces of said ferrite magnetic member is two, and a height of an upper portion of the respective piece is set to be 30 mm or less and a height of a lower portion of the respective piece is set to be 15 mm or less.

5. A broad-band radio wave absorber as claimed in claim 3, wherein either of a loss dielectric material and a magnetic membrane is disposed on or over top sections of uppermost portions of said pieces of said ferrite magnetic member.

6. A broad-band radio wave absorber as claimed in claim 3, wherein said reflecting plate is composed of a metal plate provided with either of a number of small perforations and a wire-net structure.

* * * * *